US005611455A

United States Patent [19]

McCreary

[11] Patent Number: 5,611,455

[45] Date of Patent: Mar. 18, 1997

[54] DISPENSER AND METHOD OF DISPENSING INDIVIDUAL SHEETS FROM CONTINUOUS BULK MATERIAL

[76] Inventor: Wilma McCreary, HC73-Box 864, Hwy 11 S,, Barbourville, Ky. 40906-9518

[21] Appl. No.: 494,646

[22] Filed: Jun. 23, 1995

[51] Int. Cl.[6] ..... A47K 10/24

[52] U.S. Cl. ..... 221/45; 206/409; 225/106

[58] Field of Search ..... 221/45, 46, 33, 221/63, 62; 206/812, 409, 408, 389, 824; 225/106

[56] References Cited

U.S. PATENT DOCUMENTS

D. 335,987 6/1993 Braley .

4,191,307 3/1980 Le Caine, Jr. et al. ..... 221/45

4,796,781 1/1989 Windorski ..... 221/45

5,205,454 4/1993 Schutz et al. ..... 225/106

5,228,632 7/1993 Addison et al. ..... 206/409

*Primary Examiner*—Kenneth Noland

*Attorney, Agent, or Firm*—Jack E. Toliver

[57] ABSTRACT

A relatively heavy, free standing dispenser for continuous rolled plastic sheet material separable by tear lines. The roll is supported in a vertical position and is unwound by a steady force applied to the running end which extends through an opening of the dispenser. A sudden force is applied to separate individual sheets when the tear line passes the opening. The mass of the dispenser acts through the roll on the running end to oppose this force causing each sheet to separate cleanly beyond the opening.

10 Claims, 2 Drawing Sheets

DISPENSER AND METHOD OF DISPENSING INDIVIDUAL SHEETS FROM CONTINUOUS BULK MATERIAL

The present invention pertains to a dispenser of individual sheets from continuous bulk material rolled upon itself and a method of dispensing sheets separated by tear lines, such as household plastic trash bags.

BACKGROUND OF THE INVENTION

Dispensers of a roll of plastic trash bags are known such as pictured in design D335,987 entitled "Bulk Garbage Bag Dispenser", issued Jun. 1, 1993 in which a device generally in the shape of a clothes hanger has a bottom horizontal rod passing through the center of the roll. The rod rotatably supports the weight of the roll. In this design when the running end was pulled in an effort to tear off any single bag the roll would spin unless held by one hand. Hence dispensers usually have a roll that brakes or stops unwinding when the running end is pulled. With rolled plastic bags separated by tear lines, the plastic connections are sufficiently strong and elastic that it takes two hands and a vigorous action to separate an individual bag from the running end unless the roll is mechanically held against unwinding.

A patent which attempts to deal with this problem in a wall mounted dispenser for plastic bags is U.S. Pat. No. 4,191,307 entitled "Dispenser for Plastic Bags" issued Mar. 4, 1980. This dispenser has a box like cover mounting a coreless plastic roll in the horizontal position. The running end is pulled through a horizontal opening.

Individual bags are separated by jerking outwardly and downwardly in a sudden racking motion. The shape of the cover is designed to pinch the roll in a trench that loosely checks its tendency to unwind.

While the 307 patent attempts to deal with certain problems associated with dispensing individual plastic bags from a coreless roll, the solution is to rely upon the shape of the cover to avoid unspooling the roll from the dispenser.

SUMMARY OF THE INVENTION

In accordance with the present invention a dispenser and method are provided of dispensing a roll in which the individual sheets are detachable successively by a sudden pulling force resisted by the inertia of the dispenser. A relatively heavy dispenser supplies a critical mass that creates an inertial force acting to oppose the snap, jerking, or sudden pulling force on the end of the roll sufficiently to counteract the tendency to unwind the roll, and causing the individual sheets to cleanly separate along the tear lines. The roll is placed vertically on a rotatable platform at the bottom of the dispenser. A restricted opening in the side of the dispenser, through which the running end passes, isolates the snap force at the tear line beyond the opening where it is massively opposed by the inertia of the dispenser acting on the roll inside to prevent it from unspooling.

According to the method, the invention provides the steps of standing a roll up on its end in a vertical position which orients the tear lines of the sheet material in a generally vertical plane. Passing the free end of the roll through an opening which shapes the running end behind each tear line. Applying a snap force with one hand to the running end once the tear line passes the opening while massively resisting the snap force by the inertia of the dispenser.

Accordingly, one of the objects of the invention is to provide a dispenser for bulk plastic sheet material that effectively dispenses individual sheets from a roll using one hand without it unspooling.

Another object is to provide a dispenser of molded ceramic construction decoratively glazed to fit in with the decor wherever the dispenser is located.

Another object is to provide a dispenser of a size in which the ceramic mass supplies the necessary weight when molded as a large jar and cover.

Another object is to provide a dispenser which may be left in the open, such as in the kitchen, adding to the decor and which may be moved to other locations, indoors or out, because of its ceramic construction.

These and other objects, or advantages of the invention will be more clearly apparent from the following detailed description thereof which proceeds with a description of the drawings.

DESCRIPTION OF THE PREFERRED EMBODIMENT

Figure 1:
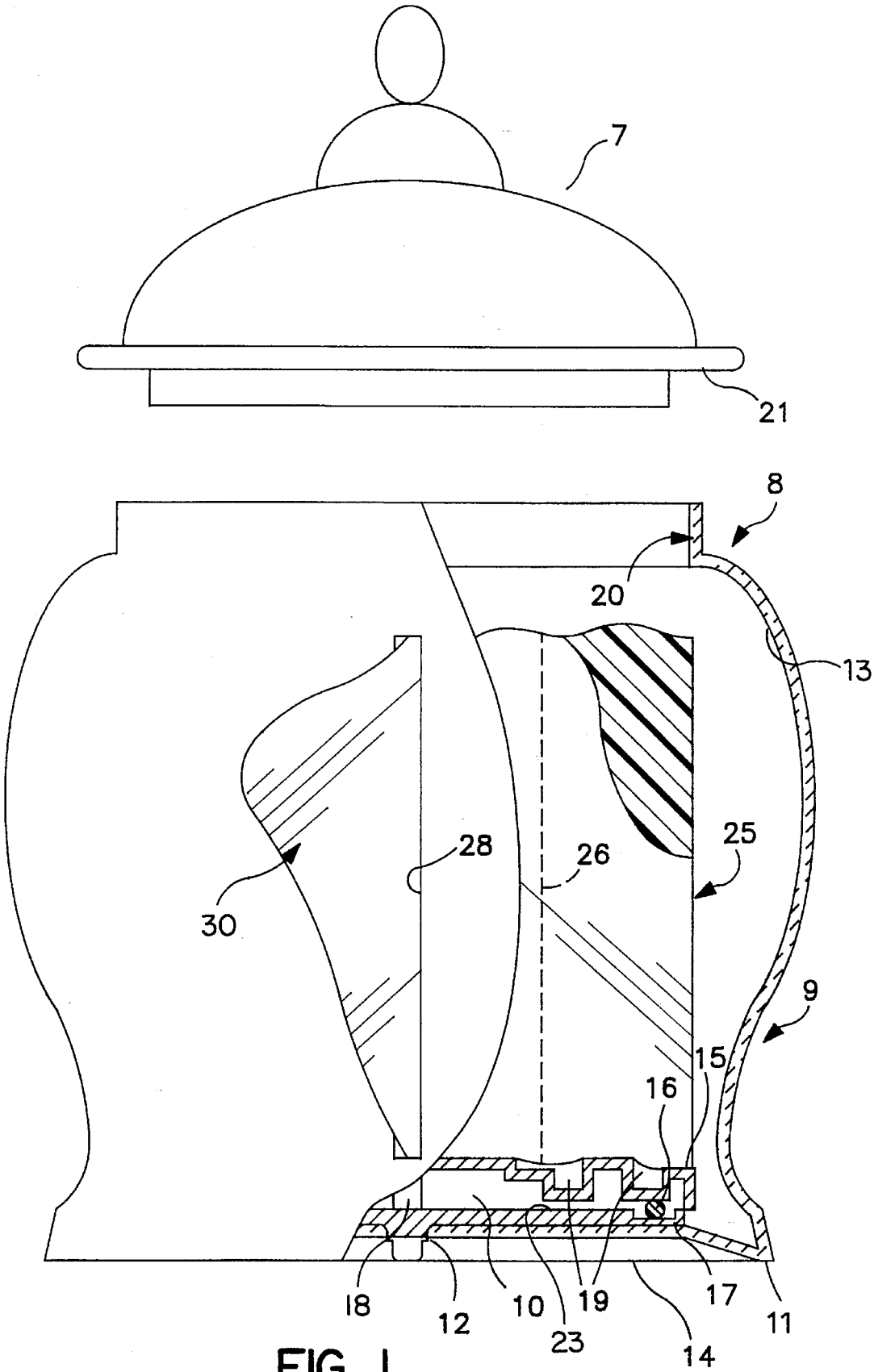
FIG. 1 is an elevational view of a ceramic dispenser and cover, one side of the dispenser being partially broken away to show a plastic trash bag roll inside, the running end of which extends through a slot in the wall of the dispenser.

FIG. 1 shows a dispenser (8) in the form of a two piece ceramic jar having a body (9) with a removable cover (7). A bottom wall (12) of the dispenser jar body (9) is formed with annular dropped edge (11) from which an upwardly curving side wall (13) extends to a mouth (20) on which rests a lip (21) of the cover (7). In the bottom of the dispenser jar body (9) is a circular turntable (10) having an upper rotatable plate (15) with annular grooves (19) the outermost of which rests on bearings (16) rotatably held in a groove (17) of a stationary lower plate (23). A spindle (18) on the upper plate (15) projects through a sleeve in the center of the lower plate (23) and extends downwardly through a hole in the bottom wall (12) centering the turntable (10) on the bottom of the dispenser. The outer surfaces of the dispenser jar body (9) and cover (7) are glazed in a decorative pattern to match the decor where the dispenser is located, but the bottom edge (11) is preferably left unglazed for reasons which will become more apparent from the following description.

A bulk roll of plastic trash bags (25) is dropped through the mouth (20) of the jar body (9) and stood on its end on the rotatable upper plate (15) of the turntable (10). By conforming its plastic sheets on the bottom of the of the roll partially to concentric grooves (19) of the turntable (10), the roll (25) is stabilized. A vertical slot (28) is formed in the wall (13) of the jar body (9) which is about the same vertical height as the plastic roll (25). The running end (30) of the roll is pulled through the slot (28). While it is appreciated that the roll (25) may be of any continuously wound material, the dispenser is best adapted for handling commercial or household plastic trash bags which are relatively strong and difficult to separate even with perforations or tear lines (26) separating the individual bags because the plastic connections at the tear lines (26) are elastic and have a relatively high tensile strength.

In operation, a steady pulling force is applied to the free end (30) unwinding the lead bag until the perforations (26) appear beyond the slot (28) at which point the bag is ready for separation from the running end by exerting a sudden, snap force. The inertia of the dispenser, combined with that of the roll inside, massively opposes the snap force providing an inertial resistance sufficiently great to cause tearing of the connections at the tear line (26).

Figure 2:
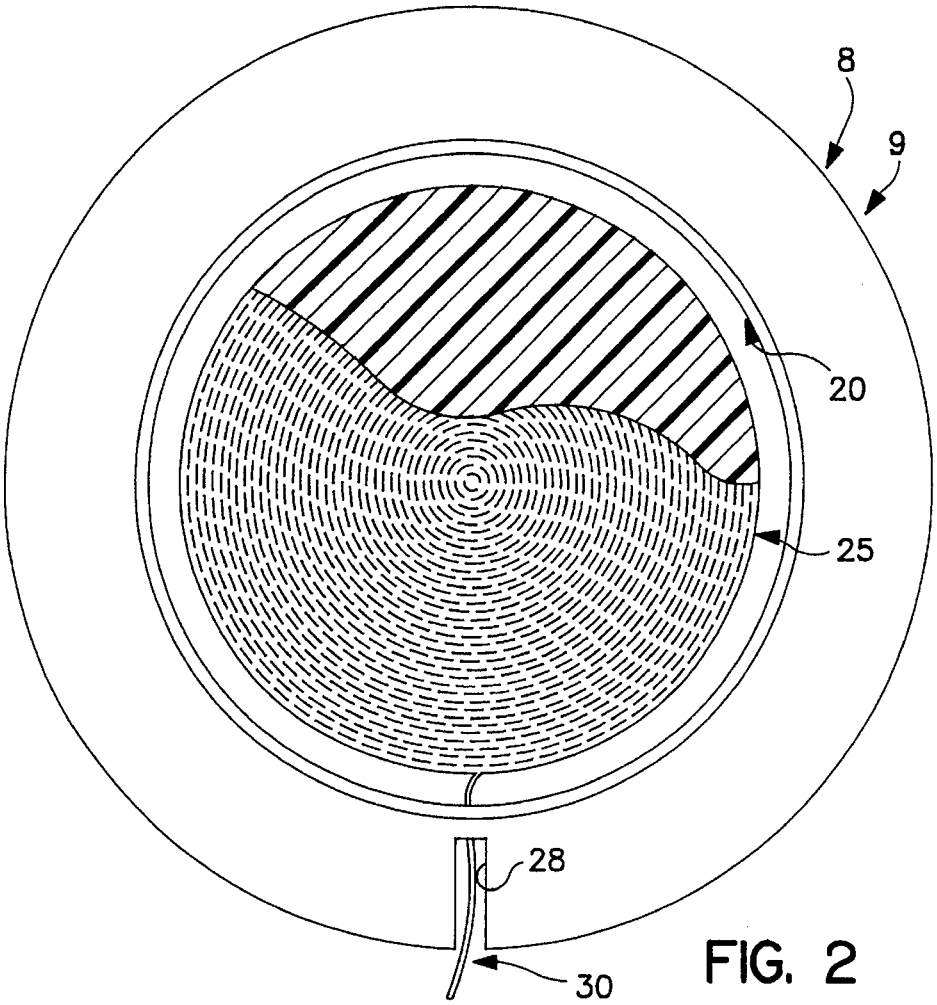
FIG. 2 is a top view of the dispenser in FIG. 1 with the cover off, the plastic roll inside being a coreless roll continuously wrapped from the center, and FIG. 2 A is a modification of the dispenser showing a round hole for taking the running end of the roll.
Figure 2A:
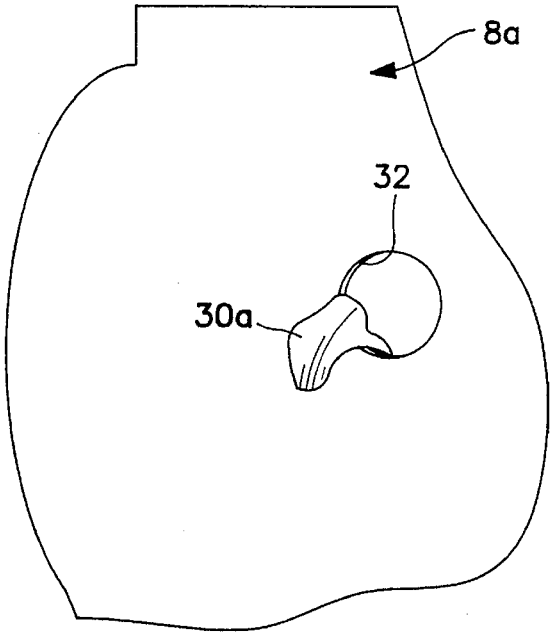

A variation of the opening (28) is shown at FIG. 2A where instead of a slot, a circular hole (32) is provided in the side wall (13) of the dispenser jar body (9). The hole (32) is small enough to gather the width of the running end (30) constricting the bags as they are pulled through for separation. An end (30*a*) of the lead bag is left exposed for pulling the running end after each separation. The shape of the slot (28), or the hole (32), facilitate a clean separation of the bags by isolating the snap force at the perforations (26) by the inertial resistive force action on the perforations in the opposite direction. The unglazed bottom edge (11) is relatively rough which creates a frictional contact with the surface on which the dispenser sits increasing the effect of the inertial force.

The jar body (9) and cover (7) together will have a mass in the range of 2–4 pounds (0.91–1.82 kg) and the plastic roll (25) initially will weigh about a pound (0.454 kg), but as the roll is depleted it will become less of a factor in the overall inertial force which is primarily derived from the mass of the dispenser. Ordinary pottery clay is suitable for molding the dispenser which has the inherent mass after firing to supply the critical mass of the dispenser.

According to the method, a roll of plastic bags separated by tear lines is stood on its end, after gathering or shaping the running end behind the tear line of each bag, a sudden tearing force is applied with one hand to the free end of the roll, while an inertial resistance force of critical magnitude is applied behind the tear lines opposing the tearing force to cause instant separation of the plastic connections between the individual bags.

While a preferred embodiment of the invention has been illustrated and described, together with certain variations, it will be appreciated that other variations may be envisioned without departing from the intended scope of the invention as set forth in the appended claims.

I claim:

1. A dispenser for a roll of sheet material having tear lines separating the individual sheets which are detachable successively from the roll by a snap force applied to the free end of the roll comprising a free standing container having a critical mass into which the roll is inserted, an opening through which a free end of the roll is pulled from the container, the container having a mass physically connected through the roll creating an inertial force on the free end and opposing the snap force beyond the opening by an amount sufficient to separate the individual sheets at the tear lines once they are past the opening, said roll comprising a series of plastic trash bags continuously wrapped from the center outwardly without a core having a mass initially of about two pounds, said dispenser having a bottom and vertical side walls, a turntable supported on the bottom providing an upper rotatable surface onto which the roll of plastic bags is placed supported vertically on the turntable which upper surface cooperates with the roll in adding the inertia of the roll to the dispenser, said opening being in the side wall of the dispenser through which the running end of the roll is pulled, the opening being shaped to constrict the running end of the roll behind each tear line.

2. A dispenser as set forth in claim 1 having a bottom and vertical sidewalls, a turntable supported on the bottom providing an upper rotatable surface, annular grooves formed in the upper surface of the turntable into which the rolled up plastic bags are pressed by the weight of the roll supported vertically on the turntable to assist in adding the inertia of the roll to that of the dispenser.

3. A dispenser as set forth in claim 2 wherein the opening is in the side wall of the dispenser through which the running end of the roll is pulled, the opening being shaped to constrict the running end of the roll behind the tear lines.

4. A dispenser as set forth in claim 3 wherein the opening is a vertical slot that orients the tear lines vertically to aid in tearing off individual bags.

5. A dispenser as set forth in claim 3 wherein the opening is a circular hole that constricts the running end behind each tear line for isolating the snap force outside of the container.

6. A ceramic dispenser jar in combination with a roll of plastic material separated by tear lines comprising a jar body having a bottom wall with integral side walls forming an upper opening into the interior of the jar body for vertically receiving the roll of sheet material, said roll of sheet material continuously wrapped from the center outwardly providing a running end from which successive sheets are separable by transverse tear lines, a turntable supported on the bottom wall having a circular rotatable upper plate, annular concentric grooves in said upper plate into which the rolled plastic sheets are pressed partially filling the groves, and an opening in the side wall through which the free end of the roll is graspable with one hand and individual sheets separated by a sudden pull after its tear line clears the opening.

7. A ceramic dispenser jar in combination with a roll of plastic sheet material as set forth in claim 6 wherein the jar is made of pottery clay which after firing has a glazed decorative surface to match the decor and weighs in excess of two pounds with the roll of plastic sheets inside.

8. A ceramic dispenser jar in combination with a roll of plastic sheet material as set forth in claim 7 wherein the bottom surface of the jar is unglazed.

9. A ceramic dispenser jar in combination with a roll of plastic sheet material as set forth in claim 7 wherein the opening in the side wall of the jar is a vertical slot the height of which corresponds with the width of the running end of sheet material.

10. A ceramic dispenser jar in combination with a roll of plastic sheet material as set forth in claim 7 wherein the opening is a round hole the size of which causes the individual sheets to be constricted as they are pulled off of the roll.

* * * * *